US005369893A

United States Patent [19]

Perito

[11] Patent Number: 5,369,893

[45] Date of Patent: Dec. 6, 1994

[54] SOAP DISH CLOTHES DRYING APPARATUSES

[76] Inventor: Tony Perito, 264 Cole Pla., Belford, N.J. 07718

[21] Appl. No.: 224,506

[22] Filed: Apr. 7, 1994

[51] Int. Cl.[5] ..... F26B 25/00

[52] U.S. Cl. ..... 34/239; 34/90; 211/86; 211/87; 248/205.1

[58] Field of Search ..... 34/90, 91, 239, 240, 34/104, 105; 211/86, 87; 248/205.1, 231.91

[56] References Cited

U.S. PATENT DOCUMENTS

| | | | |
|---|---|---|---|
| 3,471,031 | 10/1969 | Coplan | 211/86 |
| 4,112,525 | 9/1978 | Roberts | 4/154 |
| 4,846,356 | 7/1989 | Dubuc | 211/106 |
| 4,856,206 | 8/1989 | Klein | 34/239 |
| 4,917,249 | 4/1990 | King | 211/86 |
| 5,087,007 | 2/1992 | Gaderick | 248/215 |

*Primary Examiner*—Denise L. Gromada
*Attorney, Agent, or Firm*—Michael J. Colitz, Jr.

[57] ABSTRACT

A clothes drying apparatus is adapted for use in association with a soap dish of the type having a planar, generally rectangular back section with a front surface and a rear surface. The vertical back section has parallel horizontal long sides, parallel vertical short sides, an upper region and a lower region. The lowermost extent of the lower region includes a frontwardly extending planar, horizontal ledge with a small thickness and corners. The upper region includes a frontwardly extending planar, generally rectangular horizontal segment with a small thickness. The segment also includes a centrally located, generally oval shaped aperture extending therethrough. The soap dish is adapted to be affixed to a vertical mounting surface. A clothes drying apparatus comprises a central shaft with an upper section and a lower section. The lower section has a contiguous long concave depression shaped in a generally semi-circular configuration. The end of the long concave depression which is located furthest from the lower end extends frontwardly to form a ledge. The lower section is adapted to be positioned in a soap dish in the operative orientation. The upper section includes a planar front face a plurality of spaced circular apertures which extend through from side to side. A plurality of dowels are shaped in a generally cylindrical configuration with flat ends and a centrally located middle region therebetween adapted to be positioned in an aperture in the central shaft.

5 Claims, 4 Drawing Sheets

SOAP DISH CLOTHES DRYING APPARATUSES

BACKGROUND OF THE INVENTION

1. Field of the Invention

The present invention relates to soap dish clothes drying apparatuses and more particularly pertains to positioning the apparatuses in wall mounted soap dishes to permit drip drying of articles of clothing.

2. Description of the Prior Art

The use of clothes drying racks is known in the prior art. More specifically, clothes drying racks heretofore devised and utilized for the purpose of hang drying clothes from racks affixed above bath tubs and shower stalls are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,846,356 to Dubuc, a rigid clothes drying rack.

U.S. Pat. No. 4,112,525 to Roberts discloses a drying rack assembly for bathing compartments.

U.S. Pat. No. 3,471,031 to Coplan discloses a clothes drying rack.

U.S. Pat. No. 4,917,249 to King discloses a collapsible clothing rack.

Lastly, U.S. Pat. No. 5,087,007 to Gaderick discloses a combination shower enclosure caddy and garment hanger.

In this respect, the soap dish clothes drying apparatuses according to the present invention substantially departs from the conventional concepts and designs of the prior art, and in doing so provides an apparatus primarily developed for the purpose of positioning the apparatuses in wall mounted soap dishes to permit drip drying of articles of clothing.

Therefore, it can be appreciated that there exists a continuing need for new and improved soap dish clothes drying apparatuses which can be used for positioning the apparatuses in wall mounted soap dishes to permit drip drying of articles of clothing. In this regard, the present invention substantially fulfills this need.

SUMMARY OF THE INVENTION

In view of the foregoing disadvantages inherent in the known types of clothes drying racks now present in the prior art, the present invention provides an improved soap dish clothes drying apparatus. As such, the general purpose of the present invention, which will be described subsequently in greater detail, is to provide a new and improved soap dish clothes drying apparatus and method which has all the advantages of the prior art and none of the disadvantages.

To attain this, the present invention essentially comprises a new and improved soap dish clothes drying apparatus comprising a soap dish with a planar, generally rectangular vertical back section with a front surface and a rear surface. The back section has parallel long sides, parallel short sides, an upper region, and a lower region. The short sides are positioned vertically in the operative orientation. The lowermost extent of the lower region includes a frontwardly extending planar horizontal ledge. The ledge extends the entire width of the back section and has a small thickness and corners. The upper region includes a frontwardly extending planar, generally rectangular horizontal segment. The segment extends the entire width of the back section and has a small thickness. The segment also includes a centrally located, generally oval shaped aperture extending therethrough. The soap dish is adapted to be affixed to a vertical mounting surface such as a bathroom wall in the operative orientation. A central shaft consists of a solid generally rectangular shaped bar with an upper section and a lower section. The shaft has a front face, a back face and parallel side faces. The lower section is about one-half of the length of the upper section and includes a flat back face and a flat end at its lowermost extent. The front face of the lower section has a rounded convex portion adjacent to its lowermost extent. The convex portion is contiguous with a long concave depression. The long concave depression is shaped in a generally semi-circular configuration and extends across the entire width of the front face. The end of the long concave depression located furthest from the convex portion extends frontwardly to form a ledge. A short concave depression extends upwardly from the ledge and across the entire width of the front face. The uppermost extent of the short concave depression extends frontwardly to become contiguous with the upper section of the central shaft. The lower section is adapted to be positioned in a soap dish in the operative orientation. The upper section has a flat front face, a flat back face, and a rounded end at its uppermost extent. The upper section includes three equidistantly spaced circular apertures extending through the side faces. The back face of the upper section includes centrally located screw holes positioned perpendicular to the circular apertures in the sidewalls. Three dowels are shaped in a generally cylindrical configuration with flat ends and a centrally located middle region therebetween. The middle region of each dowel includes a centrally located screw hole adapted to be positioned in an aperture in the central shaft. Each screw hole lies in alignment with the screw hole in the back face of the central shaft. The ends of each dowel extend perpendicularly from each side face of the central shaft. Three screws each consist of a planar head portion and a body portion which has a plurality of external screw threads. The screws are adapted to be positioned through the aligned screw holes in the back face of the central shaft and middle region of the dowels. A circular ring is affixed near the upper extent of the front face of the upper section of the central shaft. The ring is adapted to hang freely when the central shaft is slanted forward in the operative orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

in this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved soap dish clothes drying apparatuses which have all the advantages of the prior art clothes drying racks and none of the disadvantages.

It is another object of the present invention to provide new and improved soap dish clothes drying apparatuses which may be easily and efficiently manufactured and marketed.

It is further object of the present invention to provide new and improved soap dish clothes drying apparatuses which are of durable and reliable constructions.

An even further object of the present invention is to provide new and improved soap dish clothes drying apparatuses which are susceptible of a low cost of manufacture with regard to both materials and labor, and which accordingly are then susceptible of low prices of sale to the consuming public, thereby making such soap dish clothes drying apparatuses economically available to the buying public.

Still yet another object of the present invention is to provide new and improved soap dish clothes drying apparatuses which provide in the apparatuses and methods of the prior art some of the advantages thereof, while simultaneously overcoming some of the disadvantages normally associated therewith.

Still another object of the present invention is to position the apparatuses in wall mounted soap dishes to permit drip drying of articles of clothing.

Lastly, it is an object of the present invention to provide new and improved soap dish clothes drying apparatuses adapted for use in association with soap dishes of the type having a planar, generally rectangular back section with a front surface and a rear surface. The vertical back section has parallel horizontal long sides, parallel vertical short sides, an upper region and a lower region. The lowermost extent of the lower region includes a frontwardly extending planar, horizontal ledge with a small thickness and corners. The upper region includes a frontwardly extending planar, generally rectangular horizontal segment with a small thickness. The segment also includes a centrally located, generally oval shaped aperture extending therethrough. The soap dish is adapted to be affixed to a vertical mounting surface. A clothes drying apparatus comprises a central shaft with an upper section and a lower section. The lower section has a contiguous long concave depression shaped in a generally semi-circular configuration. The end of the long concave depression which is located furthest from the lower end extends frontwardly to form a ledge. The lower section is adapted to be positioned in a soap dish in the operative orientation. The upper section includes a planar front face a plurality of spaced circular apertures which extend through from side to side. A plurality of dowels are shaped in a generally cylindrical configuration with flat ends and a centrally located middle region therebetween adapted to be positioned in an aperture in the central shaft.

These together with other objects of the invention, along with the various features of novelty which characterize the invention, are pointed out with particularity in the claims annexed to and forming a part of this disclosure. For a getter understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
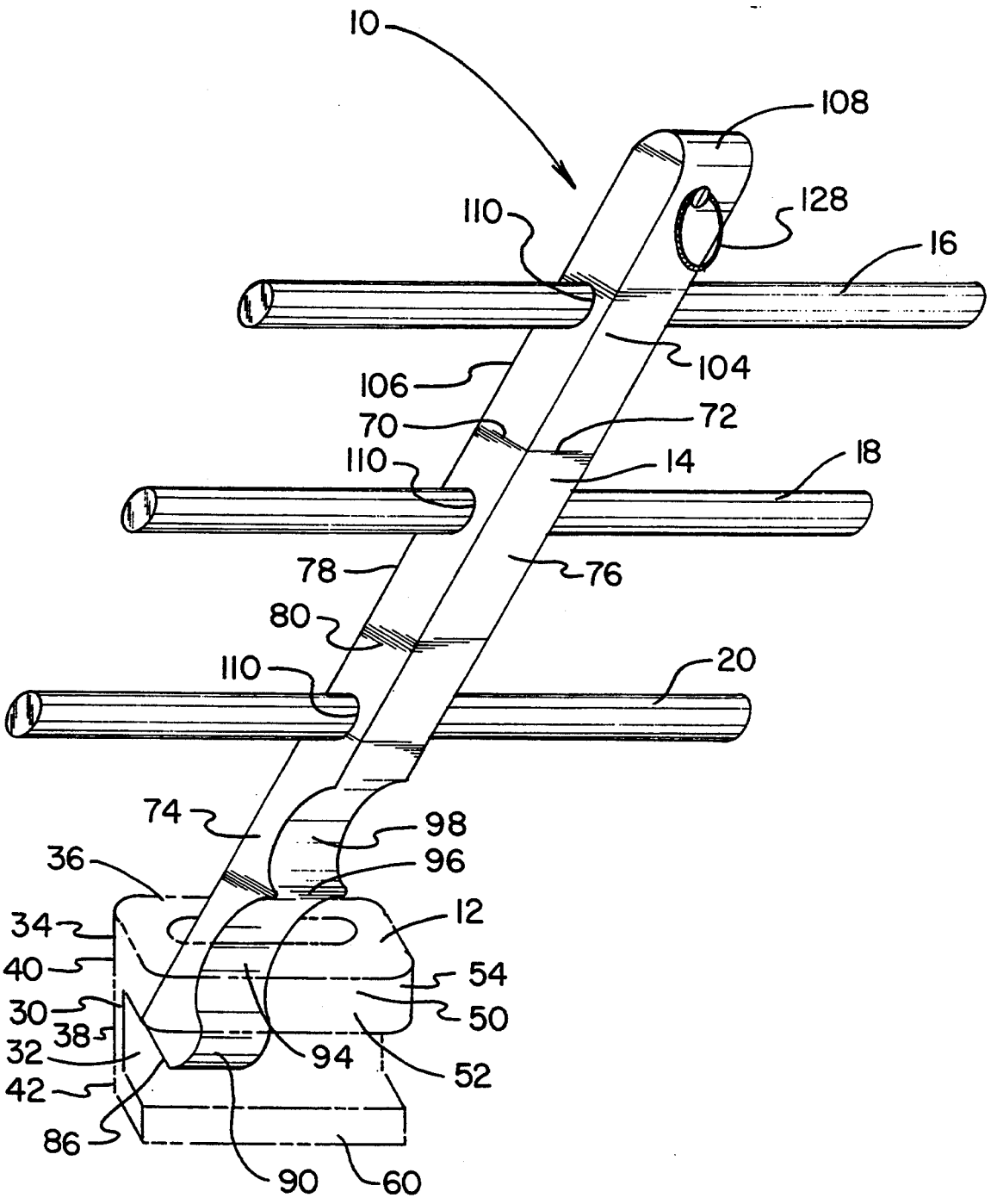
FIG. 1 is a perspective view of the preferred embodiment of the soap dish clothes drying apparatus constructed in accordance with the principles of the present invention.
Figure 2:
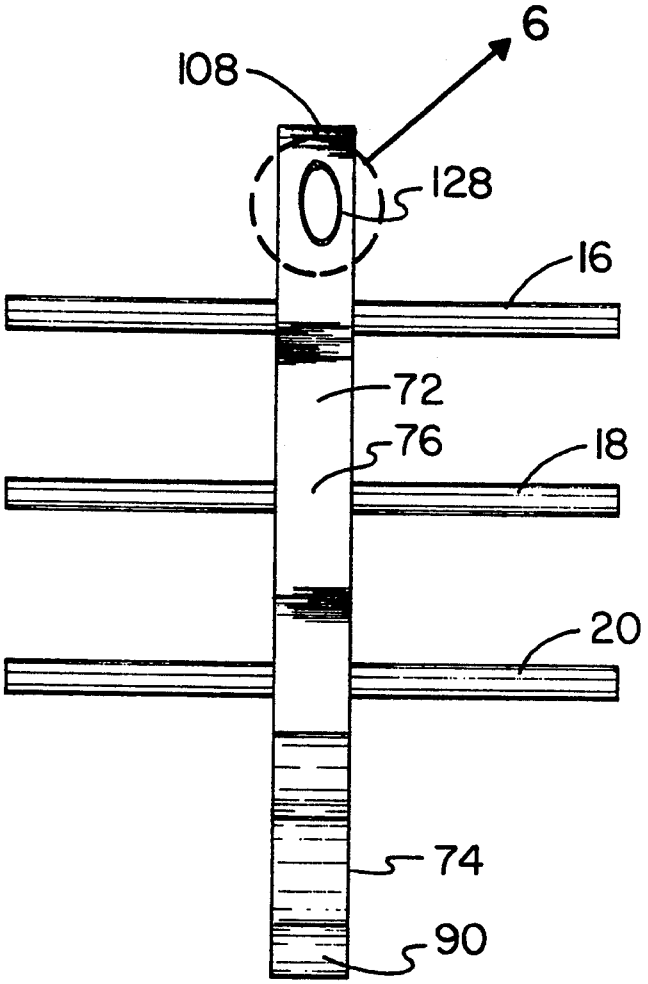
FIG. 2 is a front elevational view of the clothes drying apparatus positioned in a vertical orientation.
Figure 3:
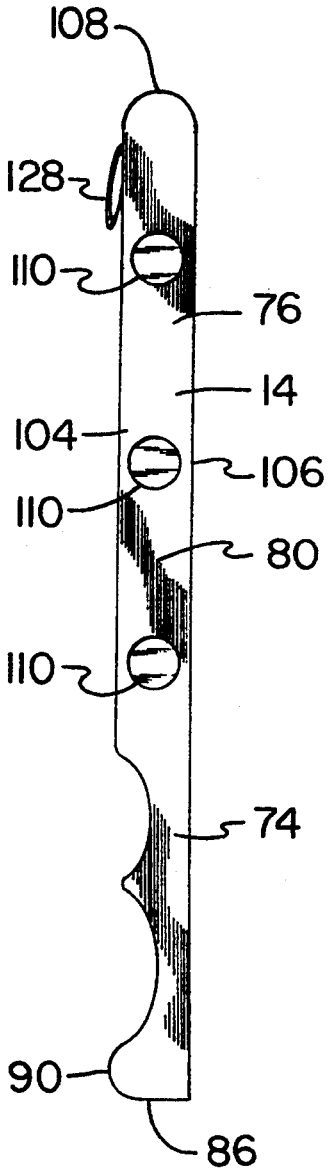
FIG. 3 is a side elevational view of the clothes drying apparatus positioned in a vertical orientation.

With reference now to the drawings, and in particular to FIG. 1 thereof, the preferred embodiment of the new and improved soap dish clothes drying apparatuses embodying the principles and concepts of the present invention and generally designated by the reference numeral 10 will be described.

Specifically, it will be noted in FIGS. 1 through 7, that there is provided a new and improved soap dish clothes drying apparatus. The clothes drying apparatus 10, in its broadest context, comprises a soap dish 12, a central shaft 14, three dowels 16, 18, 20, three screws 22 and a circular ring 28.

More specifically, the soap dish 12 has a planar, generally rectangular vertical back section 30 with a front surface 32 and a rear surface 34. The back section 30 has parallel long sides 36, parallel short sides 38, an upper region 40, and a lower region 42. The short sides 38 are positioned vertically in the operative orientation. The lowermost extent of the lower region 42 includes a frontwardly extending planar horizontal ledge 50. The ledge 50 extends the entire width of the back section 30 and has a small thickness 52 and corners 54. The upper region 40 includes a frontwardly extending planar, generally rectangular horizontal segment 60. The segment 60 extends the entire width of the back section 30 and has a small thickness 52. The segment 60 also includes a centrally located, generally oval shaped aperture 64 extending therethrough. The soap dish 12 is adapted to be affixed to a vertical mounting surface such as a bathroom wall in the operative orientation.

A central shaft 14 consists of a solid generally rectangular shaped bar 70 with an upper section 72 and a lower section 74. The shaft 14 has a front face 76, a back face 78 and parallel side faces 80. The lower section 74 is about one-half of the length of the upper section 72 and includes a flat back face 84 and a flat end 86 at its lowermost extent. The front face 88 of the lower section 74 has a rounded convex portion 90 adjacent to its lowermost extent. The convex portion 90 is contiguous with a long concave depression 94. The long concave depression 94 is shaped in a generally semi-circular configuration and extends across the entire width of the front face. The end of the long concave depression 94 located furthest from the convex portion 90 extends frontwardly to form a ledge 96. A short concave depression 98 extends upwardly from the ledge 96 and across the entire width of the front face. The uppermost extent of the short concave depression 98 extends frontwardly to become contiguous with the upper section 72 of the central shaft 14. The lower section 74 is adapted to be positioned in a soap dish in the operative orientation. The upper section 72 has a flat front face 104, a flat back face 106, and a rounded end 108 at its uppermost extent. The upper section 72 includes three equidistantly spaced circular apertures 110 extending through the side faces 80. The back face 106 of the upper section 72 includes centrally located screw holes 120 positioned perpendicular to the circular apertures 110 in the sidewalls. The lower section of the central shaft is positioned in the aperture in the ledge of the soap dish. The central shaft leans forward at an angle away from the vertical back section of the soap dish in the operative orientation.

Figure 4:
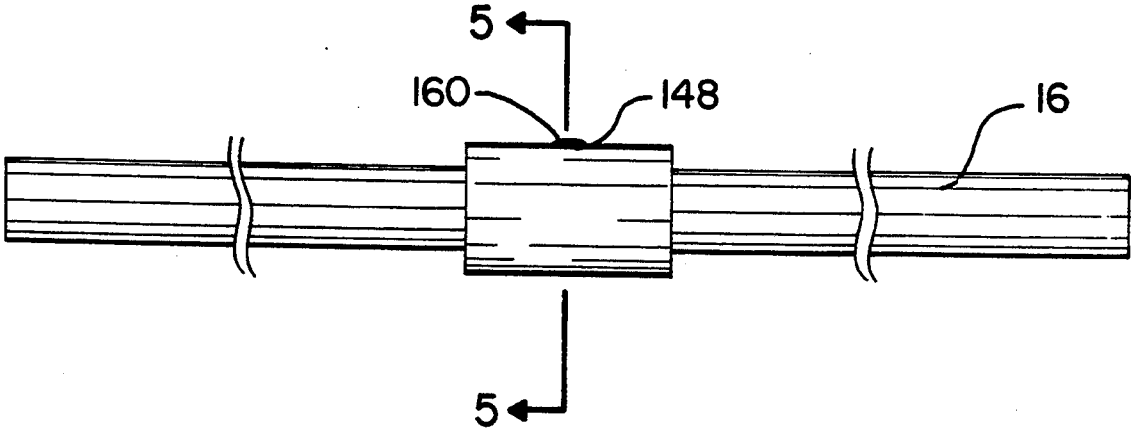
FIG. 4 is a partially broken away elevational view of one of the dowel components of the apparatus.
Figure 5:
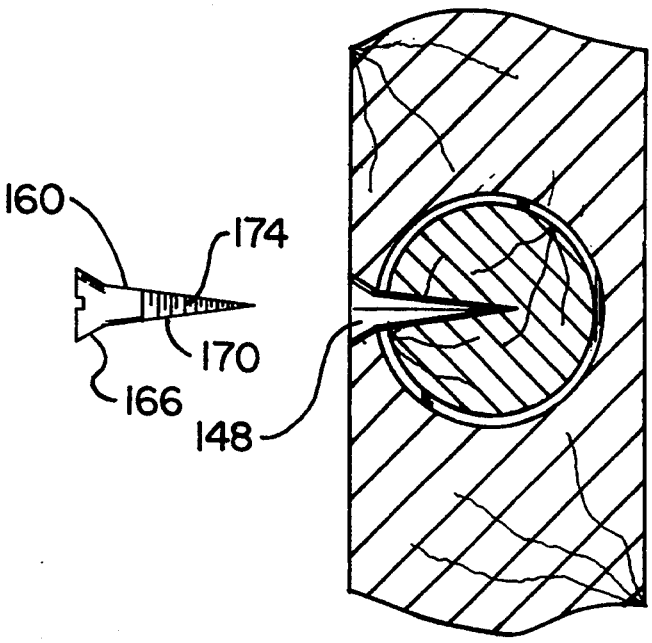
FIG. 5 is a broken away cross sectional view of the dowel shown in FIG. 5 illustrating the screw hole in the middle region of the dowel and its corresponding screw.
Figure 6:
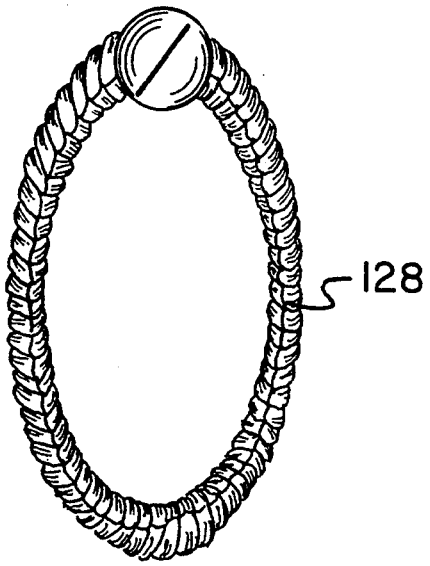
FIG. 6 is an exploded perspective view of the circular ring component shown in FIG. 2.
Figure 7:
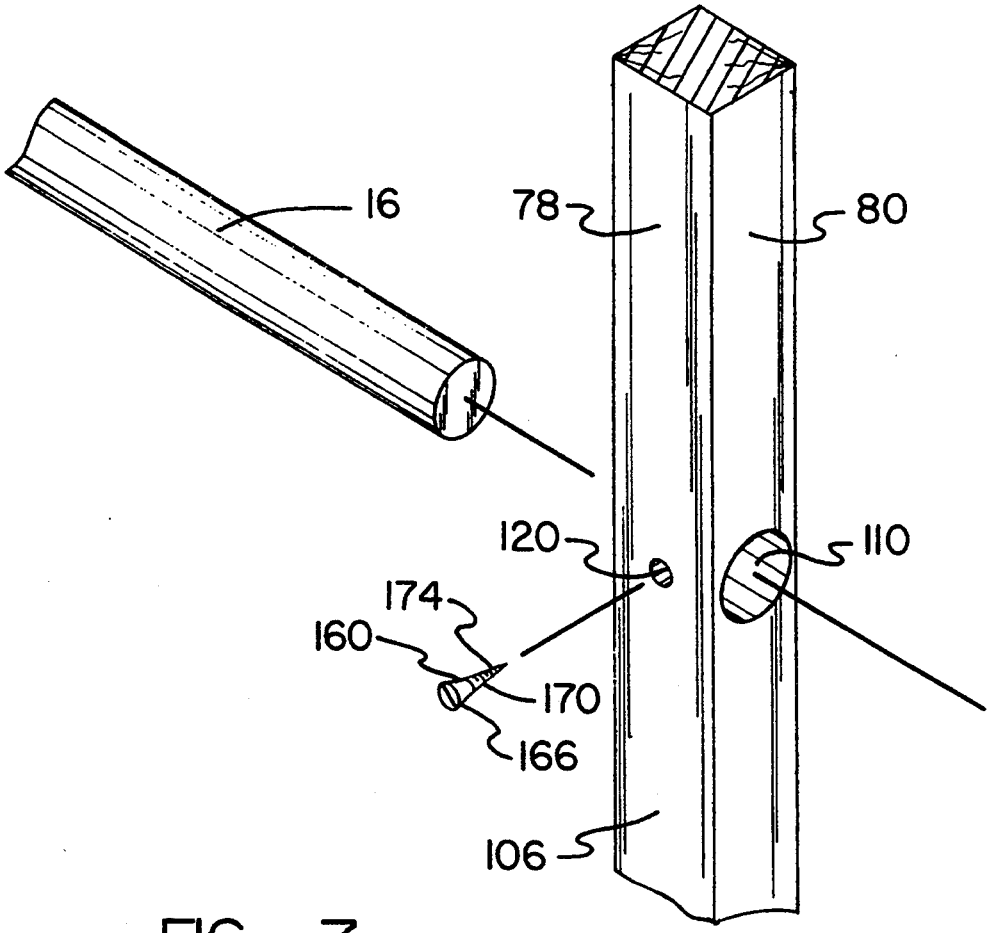
FIG. 7 is a broken away perspective view of the back face of the apparatus illustrating the positioning of a dowel and its corresponding screw.

Three dowels 16, 18, 20 are shaped in a generally cylindrical configuration with flat ends and a centrally located middle region 142 therebetween. The middle region 142 of each dowel includes a centrally located screw hole 148 adapted to be positioned in an aperture 110 in the central shaft. As shown in FIG. 4, the middle region is of an enlarged diameter for greater stability and for ensuring the central positioning of the dowels. Such central section, however, could be of a diameter the same as the dowel ends for greater economy of fabrication. Each screw hole 148 lies in alignment with the screw hole 120, 122, 124 in the back face 78 of the central shaft 14. The ends of each dowel 16, 18, 20 extend perpendicularly from each side face 80, 82 of the central shaft 14. Articles of clothing are hung from the dowels for drip drying purposes. Since the central shaft leans forward at an angle, articles of clothing hung from one dowel do not touch articles hung on any other dowel.

Three screws 160 each consist of a planar head portion 166 and a body portion 170 which has a plurality of external screw threads 174. The screws 160 are adapted to be positioned through the aligned screw holes in the back face 78 of the central shaft 14 and middle region 142 of the dowels 130. The screws retain the dowels securely within the apertures in the central shaft.

A circular ring 28 is affixed near the upper extent of the front face 76 of the upper section 72 of the central shaft 14. The ring 28 is adapted to hang freely when the central shaft 14 is slanted forward in the operative orientation. The ring permits the user to conveniently store the apparatus on a nail or hook when not in use.

The soap dish clothes drying apparatus offers a quick and easy way to hang clothes in a bathtub for drip drying purposes. It consists of a long centerpiece of wood or plastic with six rungs or dowels coming out horizontally from the center support for hanging various types of clothes. There are three rungs on one side and three on the other. It can be installed in a matter of seconds, and removal is just as easy. Panty hose, bathing suits, socks, and blouses are just some of the items suitable to be hung on this device.

Although the prototype of the soap dish clothes drying apparatus is made of wood, plastic is preferable for mass production purposes. The bottom end of the device is designed to rest in the built-in soap dish that is a standard feature of most bathtub walls. This end of the soap dish clothes drying apparatus is contoured so that the device can lean out away from the wall of the shower at an angle without falling down. It locks into place and clothes can then be hung on it for drying. When the clothes are dry, they are removed, and the end of the apparatus is lifted out of the soap dish so it can be stored until needed again. A loop is provided on the top end for hanging while in storage. For anyone looking for a quick and inexpensive way to drip dry various types of clothing in their bathtub, the soap dish clothes drying apparatus meets the need effectively.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A soap dish clothes drying apparatus comprising, in combination:

a soap dish, the dish having a planar generally rectangular back section with a front surface and a rear surface, the vertical back section having parallel long sides and parallel short sides and an upper region and a lower region, the short sides being positioned vertically in the operative orientation, with the lowermost extent of the lower region including a frontwardly extending planar horizontal ledge, the ledge extending the entire width of the back section and having a small thickness and corners, with the upper region including a frontwardly extending planar generally rectangular horizontal segment, the segment extending the entire width of the back section and having a small thickness, the segment also including a centrally located generally oval shaped aperture extending therethrough, the soap dish adapted to be affixed to a vertical mounting surface on a bathroom wall in the operative orientation;

a central shaft, the central shaft consisting of a solid generally rectangular shaped bar with an upper section and a lower section, the shaft also having a front face, a back face and parallel side faces, the lower section being about one-half of the length of the upper section and having a flat back face and a flat end at its lowermost extent, the front face of the lower section having a rounded convex portion adjacent to its lowermost extent and having a contiguous long concave depression, the long concave depression being shaped in a generally semi-circular configuration and extending across the entire width of the front face, with the end of the long concave depression located furthest from the convex portion extending frontwardly to form a ledge, with a short concave depression extending upwardly from the ledge and across the entire width of the front face, with the uppermost extent of the short concave depression extending frontwardly to become contiguous with the upper section of the central shaft, the lower section adapted to be positioned in a soap dish in the operative orientation, the upper section having a flat front face, a flat back face, and a rounded end at its uppermost extent, the upper section including three equidistantly spaced circular apertures extending through the side faces, with the back face of the upper section including centrally located screw holes positioned perpendicular to the circular apertures in the sidewalls;

three dowels, each dowel being shaped in a generally cylindrical configuration with flat ends and a centrally located middle region therebetween, the middle region of each dowel including a centrally located screw hole adapted to be positioned in an aperture in the central shaft with the screw hole lying in alignment with the screw hole in the back face of the central shaft, each dowel extending perpendicularly from each side face of the central shaft;

three screws, the screws consisting of a planar head portion and a body portion with a plurality of external screw threads, the screws adapted to be positioned through the aligned screw holes in the back face of the central shaft and middle region of the dowels; and a circular ring, the ring being affixed near the upper extent of the front face of the upper section of the central shaft, the ring adapted to hang freely when the central shaft is slanted forward in the operative orientation.

2. A clothes drying apparatus for use in association with a soap dish of the type having a planar generally rectangular back section with a front surface and a rear surface, the vertical back section having parallel long sides and parallel short sides and an upper region and a lower region, the short sides being positioned vertically in the operative orientation, with the lowermost extent of the lower region including a frontwardly extending planar horizontal ledge, the ledge extending the entire width of the back section and having a small thickness and corners, with the upper region including a frontwardly extending planar generally rectangular horizontal segment, the segment extending the entire width of the back section and having a small thickness, the segment also including a centrally located generally oval shaped aperture extending therethrough, the soap dish adapted to be affixed to a vertical mounting surface on a bathroom wall in the operative orientation, a clothes drying apparatus comprising:

a central shaft having an upper section and a lower section, the lower section having a contiguous long concave depression, the long concave depression being shaped in a generally semi-circular configuration, with the end of the long concave depression located furthest from the lower end extending frontwardly to form a ledge, the lower section adapted to be positioned in a soap dish in the operative orientation, the upper section having a front face, the upper section including a plurality of spaced circular apertures extending through from side to side; and a plurality of dowels, each dowel being shaped in a generally cylindrical configuration with flat ends and a centrally located middle region therebetween, the middle region of each dowel adapted to be positioned in an aperture in the central shaft, with each dowel extending perpendicularly from each side face of the central shaft.

3. The apparatus as set forth in claim 2 and further including:

plurality of screws consisting of a planar head portion and a body portion with a plurality of external screw threads, the screws adapted to be positioned through aligned screw holes in the back face of the central shaft and middle region of the dowels.

4. The apparatus as set forth in claim 2 and further including:

a circular ring affixed near the upper extent of the front face of the central shaft, the ring adapted to hang freely when the central shaft is slanted forward in the operative orientation.

5. The apparatus as set forth in claim 2 wherein each dowel has a central section of an increased diameter.

* * * * *